United States Patent [19]

Wedel et al.

[11] Patent Number: 4,700,493

[45] Date of Patent: Oct. 20, 1987

[54] DRYER DIFFERENTIAL PRESSURE CONTROLLER

[75] Inventors: Gregory L. Wedel; Robert C. Fosler, both of Beloit; Stanley P. Garvin, Jr., Janesville, all of Wis.

[73] Assignee: Beloit Corp., Beloit, Wis.

[21] Appl. No.: 842,260

[22] PCT Filed: Jan. 28, 1986

[86] PCT No.: PCT/US86/00195

§ 371 Date: Mar. 14, 1986

§ 102(e) Date: Mar. 14, 1986

[87] PCT Pub. No.: WO87/04475

PCT Pub. Date: Jul. 30, 1987

[51] Int. Cl.[4] ..... F26B 13/18

[52] U.S. Cl. ..... 34/48; 34/119; 34/124

[58] Field of Search ..... 34/48, 51, 54, 119, 34/124, 125

[56] References Cited

U.S. PATENT DOCUMENTS

| | | | |
|---|---|---|---|
| 2,696,679 | 12/1954 | Cram | 34/119 |
| 2,869,248 | 1/1959 | Justus | 34/124 |
| 2,885,790 | 5/1959 | Cram | 34/48 |
| 2,992,493 | 7/1961 | Fishwick | 34/48 |
| 4,222,178 | 9/1980 | Moran | 34/119 |
| 4,447,964 | 5/1984 | Gardner | 34/119 |
| 4,493,158 | 1/1985 | van Os | 34/124 |
| 4,499,668 | 2/1985 | Jumpeter | 34/119 |

FOREIGN PATENT DOCUMENTS

| | | |
|---|---|---|
| 889329 | 2/1962 | United Kingdom . |
| 1164384 | 9/1969 | United Kingdom . |

*Primary Examiner*—Albert J. Makay
*Assistant Examiner*—David W. Westphal
*Attorney, Agent, or Firm*—Dirk J. Veneman; Raymond W. Campbell; David J. Archer

[57] ABSTRACT

A control apparatus for controlling the differential pressure between steam inlet and outlet lines of a web dryer and includes a selectively controllable outlet valve disposed in the outlet line for selectively controlling the flow of blow-through steam, condensate and non-condensible gases out of the dryer. A dryer speed sensor generates a first control signal and a condensing rate sensor senses the rate at which a layer of condensate builds up within the dryer. The condensate rate sensor generates a second control signal. A control device is operably connected to an outlet valve actuator for selectively energizing the actuator in response to the first and second control signals. The control device compares the signals to determine the optimum relative setting of the outlet valve so that flooding of the dryer with condensate is inhibited while the differential pressure between the inlet and outlet lines is maintained as low as possible.

8 Claims, 7 Drawing Figures

MINIMUM DIFFERENTIAL
CONTROL SYSTEM

DRYER DIFFERENTIAL PRESSURE CONTROLLER

FIELD OF THE INVENTION

This invention relates to a control apparatus for controlling the differential pressure between steam inlet and outlet lines of a web dryer. More particularly, this invention relates to a control apparatus for controlling such differential pressure between a steam inlet and outlet line of the drying section of a paper machine.

INFORMATION DISCLOSURE STATEMENT

In a papermaking machine, a formed web passes throughh a paper drying section immediately after passing through the pressing section. Such drying sections include a plurality of rotating heated cylinders over which the wet paper web passes in order that the web may gain the required degree of dryness. More particularly, in conventional drying sections, the wet web is passed around the outside of steam-heated, cast iron drying cylinders. The steam used to heat these drying cylinders enters the dryer through hollow journals by means of rotating seals and it condenses on the inside of the dryer shell or cylinder. As the steam condenses on the internal surface of the rotating cylinders of the dryer, such condesnate is evacuated by means of a siphoning assembly. However, when such drying cylinders are operated at high speeds, such as 1,000 to 1,200 feet per minute web speed, which is not unusual in drying sections, the condensate does not collect at the bottom of the dryer but rather is thrown by centrifugal forces around the inside surface of the dryer cylinder or shell. Such disposition of the condensate within the dryer shell is known in the art as the "rimming phenomenon" and is fully described in an article published by TAPPI 1958, volume 41, No. 2 by R. E. White. When the condensate is rimming, the dryer shell is not exposed to "live steam" but is insulated from the live steam by the condensate layer which impedes the transfer of heat from the live steam to the surface of the dryer shell and subsequently to the adjacent paper web. Such insulation reduces the drying process and this resistance to heat transfer can be kept to a minimum by decreasing the depth of the layer of condensate within the dryer shell.

The accumulation of non-condensible vapors inside the dryer shell can give rise to non-uniformities in the drying characteristics of the dryer shell along the cross machine direction. This problem has been set forth by R. B. Hurm, as published in TAPPI, volume 46, No. 9, 1963. Such buildup or accumulation of non-condensible vapors or gases can be kept to a minimum by continuously allowing some of the uncondensed vapor or steam to be evacuated from the dryer shell together with the condensate. This uncondensed vapor, or blow-through is then able to entrain the non-condensible gases and keep such gases from accumulating in the dryer shell.

Additionally, such blow-through steam can have the secondary and beneficial effect of reducing the pressure differential between the inlet and outlet lines of the dryer shell, such pressure differential being required to evacuate the condensate. The low density blow-through steam entrains and mixes with the high density condensate to form a two-phase mixture with a resultant density substantially less than the condensate. The pressure differential required to evacuate this relatively low density mixture of steam and condensate against the centrifugal force caused by rotation of the dryer shell is then correspondingly reduced. Furthermore, this blow-through steam can be used in further dryer shells of the drying section that require lower pressure steam. Alternatively, such blow-through steam can be boosted or supplemented to increase the pressure thereof to be reused in the same dryer shell provided, of course, the pressure differential across the dryer shell is not too large.

A further consideration in condensate evacuation is the requirement of stability of operation. In practice, it has been observed that condensation evacuation may cease if the outer tip of the siphon pipe adjacent the condensate becomes submerged by condensate. In this event, the dryer may fill with condensate so that the drying rate is reduced and the dryer drive loads are proportionately increased. These problems are highlighted and discussed by T. A. Gardner in Pulp & Paper Magazine of Canada, volume 65, No. 14, 1964 and more specifically, in TAPPI Technical Information Sheets, TIS014-60 issued in 1983.

From the foregoing, it is evident that certain objectives are sought by a condensate evacuation system and these objectives include first, to evacuate the condensate at a rate which is at least equivalent to the rate of formation of the condensate within the dryer shell such that the dryer does not flood; Second, it is an objective to maintain the condensate layer as thin as possible such that the rate of heat transfer from the "live steam" to the paper web is as high as possible; Third, to remove by evacuation non-condensible gases such that an improved uniformity in drying rate can be achieved in the cross machine direction; Fourth, to achieve removal of condensate from the dryer shell utilizing the minimum required differential pressure while maintaining stable operation of the system.

Various methods have been proposed in an attempt to achieve the foregoing four objectives and such proposals are described in a TAPPI publication entitled "Paper Machine Steam And Condensate Systems" by H. P. Fishwick. Additionally, these basic concepts have been set forth in U.S. Pat. No. 4,447,964 to Gardner and U.S. Pat. No. 2,869,248 to Justus. Furthermore, an article by Perrault published in TAPPI, volume 62, No. 11, 1979 teaches the above objectives and an article by Jumpeter as published by TAPPI, 1984 in Engineering Conference Proceedings, page 347 also relates to the foregoing.

Although the foregoing patents and other disclosures have set forth the foregoing objectives and have proposed systems for attaining such objectives, all the prior methods and apparatis have suffered from certain inherent control problems. Although each of the foregoing systems may be adjusted to operate in an acceptable manner for particular conditions, they are not able to respond in both directions and magnitude to the changes required by occasional upsets in the system or changes in machine operating conditions.

As an example of such inability of the prior proposals, the common differential pressure controls outlined in "Paper Machine Steam And Condensate Systems", FIG. 1, allows the input of one set point. However, the required set point changes as the machine speed, the steam pressure, and the flow rate of condensate change. Because the change in the set point is a complex function of the above-noted variables. as shown in FIG. 2, the machine operator will oftentimes set the differential set point at the highest value needed to satisfy a wide range of operating conditions. Such setting of the differential set point at the highest value results in inefficient operation. Furthermore, such system also suffers from susceptibility to flooding. Additionally, if one of the siphons in one group of dryers floods, the blow-through control valve will close slightly as it maintains the fixed set point differential pressure whereas the appropriate control action would be to open the valve slightly in an attempt to unflood the dryer.

The flow-control concept shown in FIG. 3 of U.S. Pat. No. 2,869,248 to Justus avoids this latter problem by measuring and controlling the quantity of blow-through steam which is evactuated with the condensate. Subsequently, the control valve will open slightly as one dryer begins to flood. However, this system only operates on a fixed set point which is not appropriate for all operating conditions.

In the aforementioned article by Jumpeter, the system described in FIG. 4 uses a microprocessor to adjust the set point based on the rate of condensate flow from a separator tank. This controller establishes the set point by continually reducing it until the rate of condensate flow decreases. This approach, however, results in operating the dryer near, or below, the point of stable operation. In many high speed dryers the rate of condensate flow will not decrease until the differential pressure is so low that the dryer floods. Once this occurs the dryer may not be able to recover from the flooded state, even when the differential pressure is later increased.

According to the present invention, the aforementioned inadequacies of the prior art proposals are overcome by recognizing the importance of the parameters which dictate what the appropriate differential pressure will be for stable and efficient operation of the dryer section, and uses these parameters as inputs to a controller for calculation of the appropriate set point. This method at least requires the input of machine speed and condensing rate. However, the method also generally requires the input of steam pressure and can utilize a signal from a sheet break detector as an input to adjust set points for sheet break conditions.

In addition to using the aforementioned parameters which dictate the operating characteristics of the system as input values, the proposed system also provides the set point signal for the momentum of the blow-through steam. This parameter is important to insure stable and efficient operation of the evacuation system as will be described hereinafter. Such blow-through steam momentum is proportional to the product of the blow-through density and the square of the blow-through velocity. Such parameter is preferred as the output parameter in place of the differential pressure which is the mass flow rate, or the volume flow rate. The appropriate differential pressure for normal operation is recognized according to the present invention as being required to be set somewhat higher than the minimum differential in order to accommodate occasional upsets in the operation. Such occasional upsets include increased condensate flow, small fluctuations in the pressure differential and speed increases. In practice, it has been demonstrated that approximately 2 pounds per square inch of added differential should be adequate.

The aforementioned approach does not require the continual adjustment of the set point and monitoring of the resultant response as does the system described in the aforementioned article by Jumpeter. Such a control action, as described in the prior proposal continually brings the operation into an unstable region which is near the minimum differential pressure shown in the curves of FIG. 2. Rather, the present system utilizes experimentally-determined relationships as illustrated in FIG. 2, to adjust the siphon system to the most stable and efficient operating point. The system, according to the present invention, is further enhanced by use of a small radial siphon pipe having steam bleed openings and low loss vortex flowmeters. With regard to such enhanced operation, it is recognized that the requirement of low pressure losses can be achieved either by an increased radial pipe size or by a lower blow-through. The usual practice has been to utilize an increased radial pipe size. However, due to the increased sensitivity of the blowthrough to pressure differential as shown by the top curve in FIG. 2, the blow-through flow rates are generally excessively high when the dryers are operated at stable differential pressures. That is, the minimum differential pressure plus about 2 pounds per square inch. The present invention utilizes the fact that the increase in the minimum differential pressure is relatively small when reducing the size of the radial pipe, while the reduction in blow-through sensitivity is quite significant. By controlling the momentum to a value which is about 2 pounds per square inch higher differential than the minimum and by using the small radial pipes, the blow-through does not change as much during upsets in machine operation. Consequently, the valves and condensors and connecting piping are less likely to be undersized so that the system continues to operate in a stable condition even though the differential pressure is low.

According to a further aspect of the present invention, operation of the evacuation system is further stabilized by the use of steam bleed openings as described in the aforementioned Justus patent. Although the present invention controls the dryer operation away from unstable points, the use of the steam bleed opening insures that the dryer can recover from even major system upsets. By way of example, if the differential pressure were to be reduced to zero even for a short time, the tip of the siphon could become submerged in condensate. With the usual differential pressure control, the set point differential may be insufficient to lift the condensate against the centrifugal force and the dryer would remain flooded. With the Jumpeter system as described hereinbefore, the differential would be increased by the controller but only until the controller recognizes such an increase did not cause an increase in condensate flow. The flow control system described by Perrault and U.S. Pat. No. 2,869,248 to Justus however, would attempt to increase the differential in order to satisfy the blow-through set point flow rate. But on high speed machines the necessary flow may be obtained from only a few unflooded dryers in a section of dryers while the corresponding differential is not sufficient to unflood the rest of the dryers. With the system according to present invention, the set point, of blow-through momemtum will also cause the differential to increase in order to achieve set point flow. Furthermore, the required differential to evacuate the flooded dryers is simultaneously reduced by the decrease in density of the evacuated condensate by the addition of blow-through steam which enters the steam bleed opening located above the condensate level. Also, the system will automatically increase the set Point due to the reduced condensate flow. The combined effect of these three actions is to provide a heretofore unachievable range of stability of operation.

A third feature which is incorporated in the system according to present invention is the use of low loss meters. Such low loss meters may include a simple orifice flowmeter with a small restriction or a vortex type meter. The former is used in the art and provides a pressure drop which is directly proportional to the blow-through momentum. The pressure drop can be measured and used as input for the controller. Although such orifice flowmeters are commercially available, the signal obtained from the same is often processed to provide a volume of, or mass flow. According to the present invention, it is proposed here that the frequency of the shedding of vortices be used instead as the direct input to the controller. This frequency is also related to the momentum of the blow-through. Such devices can be used as part of the control system without adding significantly to the pressure losses.

Another feature of the present invention is the method of selecting the set point for the blow-through flow rate. By careful testing, a series of curves similar to those shown in FIG. 3 can be established. The desired operating set points can be determined by first locating the minimum differential pressure point for the given conditions of speed, dryer pressure, condensing rate and siphon size. To this value is added such increment of about 2 pounds per square inch as mentioned hereinbefore to allow for minor upsets in operation. The blow-through which corresponds to this differential is then used to calculate the momentum of the blow-through which is used as the set point.

A series of these calculations can be made for any given siphon geometry and then the set point momentum values plotted as a function of condensing load for each speed. The controller can then use the measured condensing rate and speed as inputs to calculate the desired set point using the curves of FIG. 2. Typical curves of this type are shown in FIG. 5.

Occasionally, it has been observed that the set point determined by these procedures may provide a volume rate of blow-through which is less than that required for proper noncondensible evacuation. It may, therefore, be desirable to have as a minimum some specific volume flow rate and use the controller to check for, and insure this minimum is always satisfied.

A primary objective of the present invention is the provision of a method and apparatus for extracting a condensate from a rotating cylinder of a paper dryer that overcomes the aforementioned inadequacies of the prior art proposals and which provides a significant contribution to the art of web drying.

Another objective of the present invention is to provide a method for indirectly controlling the pressure differential across a heated dryer in response to the dryer speed and condensate flow rate by the direct control of the momentum flow rate of the uncondensed vapor.

Another objective of the present invention is the provision of a control apparatus for controlling the differential pressure between a steam inlet and outlet line of a web dryer in which control signals generated respectively by a speed sensor and a rate of condensation sensor are compared by a control device to determine the optimum relative setting of the outlet valve so that flooding of the dryer with condensate is inhibited while maintaining the differential between the inlet and outlet lines as low as possible.

Other objectives of the present invention will be readily apparent to those skilled in the art from the disclosure of the drawings, description and appended claims.

STATEMENT OF INVENTION

The present invention relates to a control apparatus and method for controlling the differential pressure between a steam inlet line and an outlet line of a web dryer. The apparatus includes a selectively controllable outlet valve disposed within the outlet line of the dryer for selectively controlling the flow of steam, condensate and non-condensible gases out of the dryer. An outlet valve actuating means is disposed adjacent to the outlet valve for selectively controlling the operation of the outlet valve between a fully open and a fully closed setting thereof. A speed sensing means is disposed adjacent to the dryer for sensing the rotational speed of the dryer and for generating a first control signal proportional to the sensed rotational speed of the dryer. A rate of condensation sensing means for sensing the rate at which a layer of condensate builds up within the dryer for generating a second control signal proportional to the sensed rate of buildup. A control means is operably connected to the outlet actuating means for selectively energizing the actuating means in response to the control signals generated respectively by the speed sensing means and the rate of condensation sensing means. The arrangement is such that the control means compares the signals from the speed sensing means and the rate of condensation means to determine the optimum relative setting of the outlet valve so that flooding of the dryer with condensate is inhibited while the differential pressure between the inlet and outlet lines is maintained as low as possible.

In a more specific embodiment of the present invention, the control apparatus includes a steam inlet pressure sensing means which is disposed adjacent to the steam inlet line for sensing the pressure of the steam entering into the dryer and for generating a third control signal which is proportional to the sensed pressure in the inlet line. The third control signal from the steam inlet pressure sensing means is compared by the control means for further determining the optimum relative setting of the outlet valve.

Furthermore, the control apparatus includes a sheet break sensing means which is disposed adjacent to the web for sensing a break therein and for generating a fourth control signal indicative of such web breakage. The fourth control signal from the break sensor is compared by the control means for further determining the optimum relative setting of the outlet valve in order to inhibit the excessive wastage of blow-through steam in the event of such web breakage.

Additionally, the control apparatus includes a blow-through steam sensing means which is disposed in the outlet line for sensing the momentum of blow-through steam exiting from the dryer. The blow-through steam sensing means generates a fifth control signal which is proportional to the momentum of the blow-through steam. Such fifth signal is compared by the control means for further determining the optimum relative setting of the outlet valve in order to insure stable and efficient operation of the system for evacuating condensate from within the dryer.

The control apparatus includes an orifice flowmeter means which is disposed within the outlet for measuring the blow-through steam momentum. The orifice flowmeter has a flow restricting passage for providing a pressure drop which is directly proportional to the blow-through momentum. The blow-through steam sensing means is also connected across the passageway for sensing the steam blow-through momentum.

In a particular embodiment of the present invention, the control means is a microprocessor and the dryer includes a radial siphon means which is disposed within the dryer for removing condensate therefrom. The siphon pipe has an inside diameter of 2.29 centimeters or less.

Although a specific embodiment of the present invention is described in the attached drawings and detailed description as set forth hereinafter, it should be appreciated by those skilled in the art that such preferred embodiment of the present invention is given only by way of an example of how the apparatus and method according to the present invention may be carried out and that numerous variations on the basic concept may be used without departing from the spirit and scope of the present invention as defined by the appended claims.

Furthermore, although the invention is particularly described as applicable pecifically to the drying section of a papermaking machine, it should be appreciated that the present invention as defined by the appended claims envisages application to control systems for drying webs of any suitable material.

BRIEF DESCRIPTION OF THE DRAWINGS

Similar reference numerals are used throughout the various figures of the drawings to represent similar parts.

DETAILED DESCRIPTION

Figure 1:
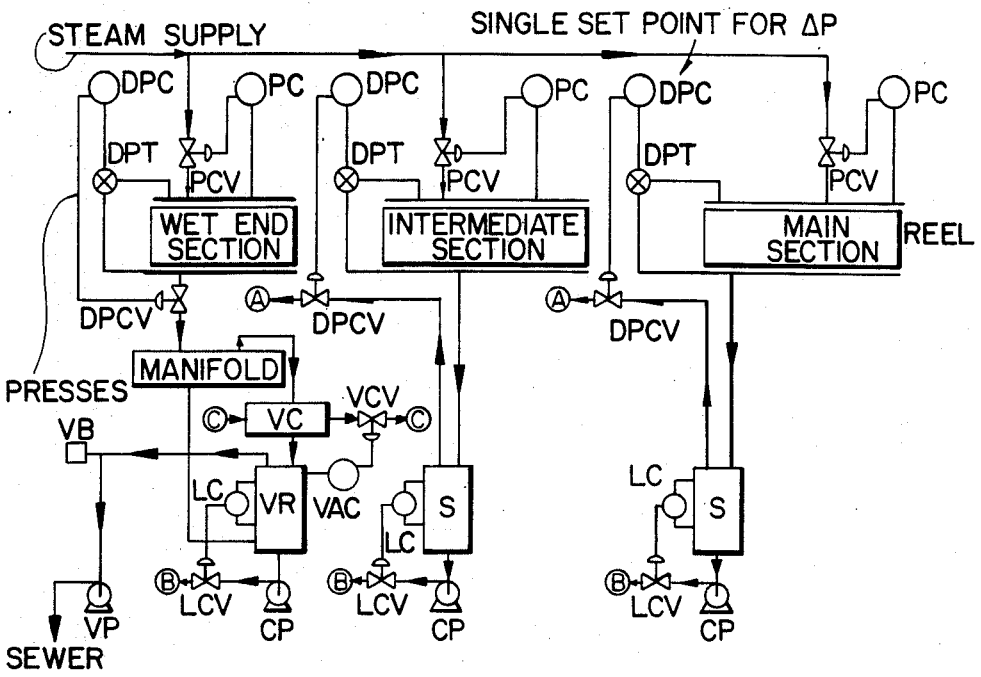
FIG. 1 PRIOR ART
FIG. 1 is a block diagram of a prior proposal relating to common differential pressure controls as outlined in "Paper Machine Steam And Condensate Systems" by H. P. Fishwick as described hereinbefore.
Figure 3:
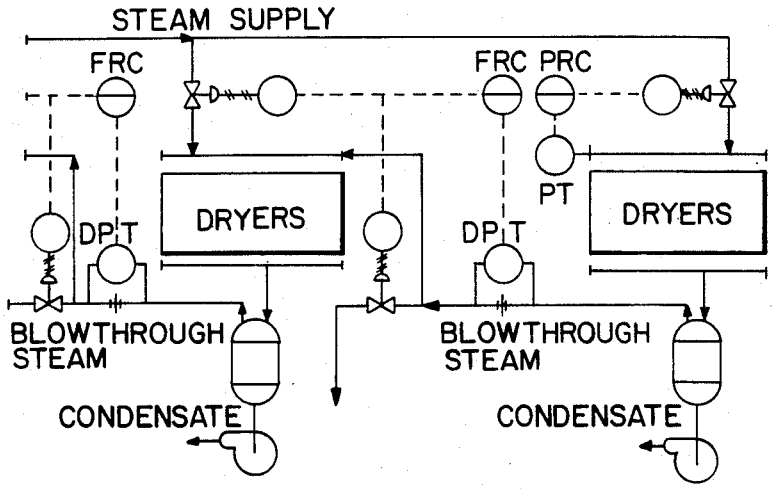
FIG. 3 PRIOR ART
FIG. 3 shows the flow control concept as outlined in FIg. 3 of U.S. Pat. No 2,869,248 to Justus as described hereinbefore.
Figure 4:
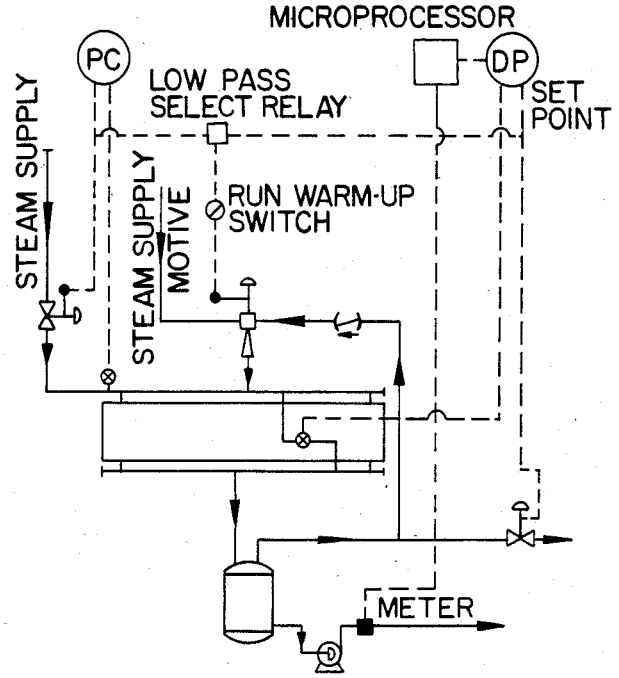
FIG. 4 PRIOR ART
FIG. 4. shows a prior disclosure by Jumpeter as taught by the aforementioned Jumpeter article in TAPPI 1984, Page 347.

FIGS. 1, 3 and 4 show various prior art control apparatus for controlling the evacuation of condensate out of a dryer shell.

Figure 2:
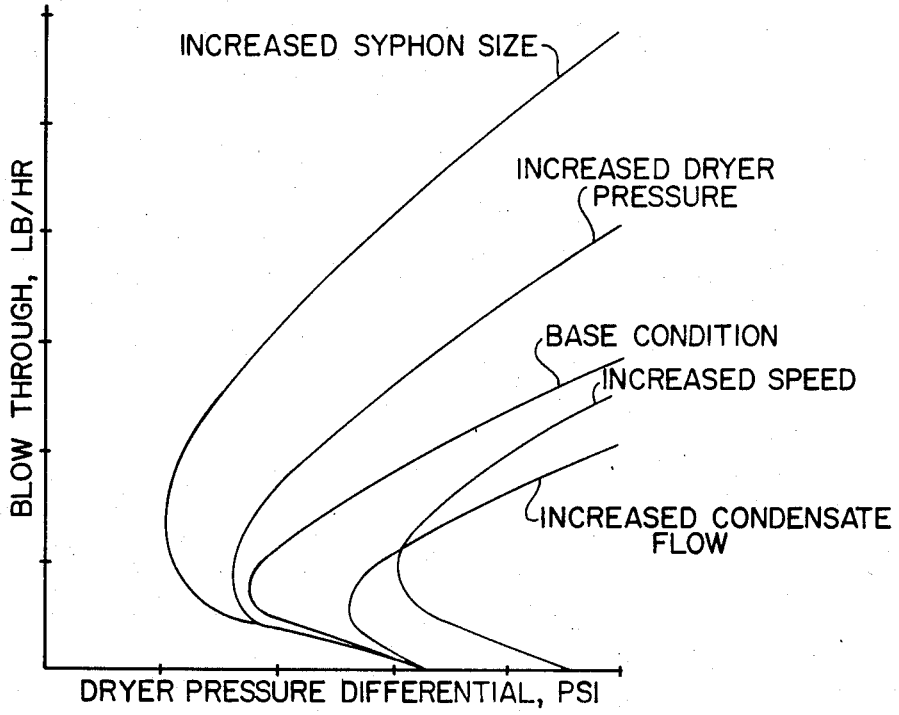
FIG. 2 is a graph showing dryer pressure differential to blow-through rate.

FIG. 2 shows a graph used to adjust the siphon system for the most stable and efficient operating point.

Figure 5:
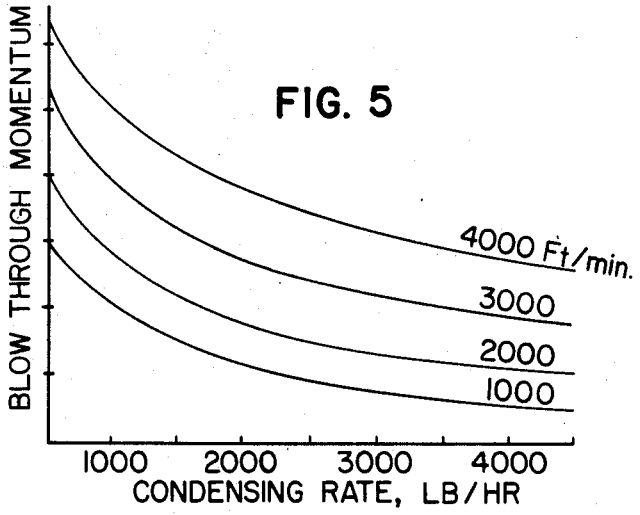
FIG. 5 is a graph showing condensing rate to blow-through momentum illustrating typical curves using given siphon geometry.

FIG. 5 is a graph used to adjust the controller by using the measured condensing rate and speed as inputs to calculate the desired set points.

Figure 6:
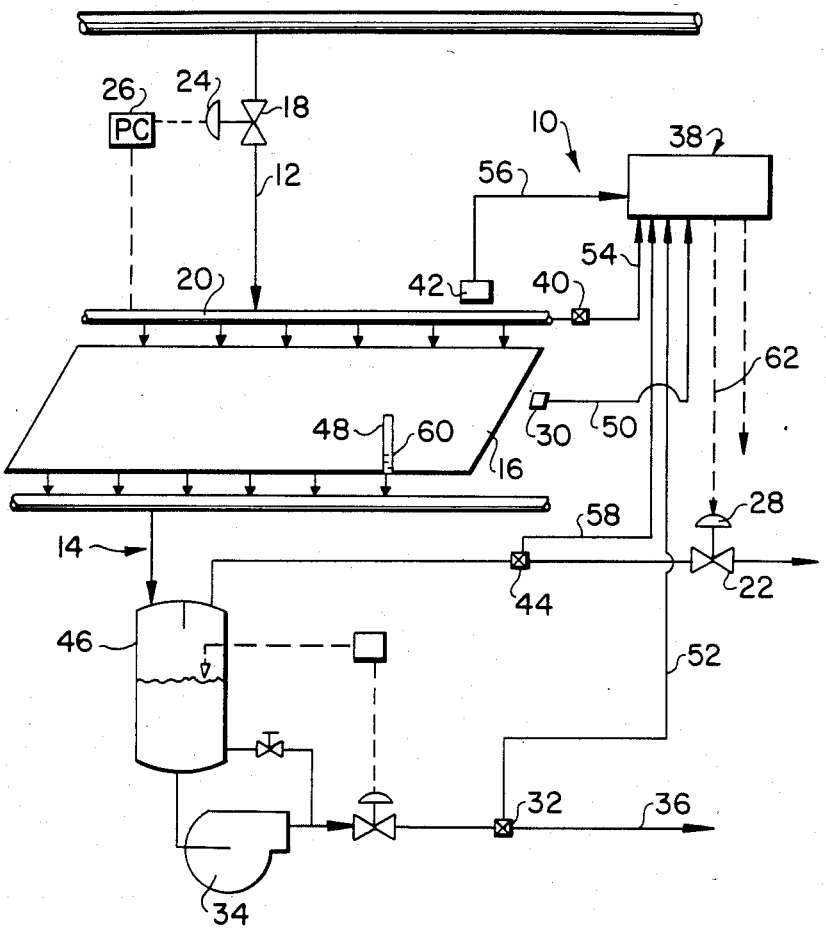
FIG. 6 is a diagrammatic representation of the control apparatus according to the present invention.

FIG. 6 shows a specific embodiment of the present invention and shows a control apparatus generally designated 10 for controlling the differential pressure between a steam inlet or supply line 12 and an outlet line generally designated 14 of a web dryer 16. The apparatus 10 includes a controllable inlet valve 18 disposed within the steam inlet line 12 for selectively controlling the flow of steam through a supply header 20 into the dryer 16. A selectively controllable outlet valve 22 is disposed within the outlet line 14 of the dryer 16 for selectively controlling the flow of steam, condensate and non-condensible gases away from the dryer 16. An inlet valve actuating means 24 is disposed adjacent to the inlet valve 18 for selectively controlling the operation of the inlet valve 18 between a fully open or fully closed setting thereof in accordance with a pressure controller 26. An outlet valve actuating means 28 is disposed adjacent to the outlet valve 22 for selectively controlling the operation of the outlet valve 22 between a fully open and fully closed setting thereof. A speed sensing means 30 is disposed adjacent the dryer 16 for sensing the rotatioal speed of the dryer 16 and for generating a first control signal which is proportional to the sensed rotational speed of the dryer 16. A rate of condensation sensing means 32 is disposed between a condensate pump 34 and condensate return 36 for sensing the rate at which a layer of condensate builds up within the dryer 16 and for generating a second control signal which is proportional to the sensed rate of buildup. A control means generally designated 38 is operably connected to the outlet actuating means 28 for selectively energizing the actuating means 28 in response to the control signals generated by the speed sensing means 30 and the rate of condensation sensing means 32 such that the control means 38 compares the signals from the speed sensing means 30 and the rate of condensation sensing means 32 to determine the optimum relative setting of the outlet valve so that flooding of the dryer 16 with condensate is inhibited while the differential pressure between the inlet and outlet lines is maintained as low as possible.

As shown in FIG. 6, the control apparatus 10 also includes a steam inlet pressure sensing means 40 for sensing the pressure of steam between the inlet valve 18 and the dryer 16 and for generating a third control signal which is proportional to the sensed pressure between the inlet valve 18 and the dryer 16. The third control signal from the steam inlet pressure sensing means 40 is compared by the controller means 38 for further determining the optimum relative setting of the outlet valve 22.

In addition to the aforementioned sensing means, the control apparatus 10 also includes a sheet break sensing means 42 which is disposed adjacent to the web for sensing a break therein and for generating a fourth control signal indicative of such web breakage. The fourth control signal from the break sensor 42 is compared by the control means 38 for further determining the optimum relative setting of the outlet valve 22 and in order to inhibit the excessive wastage of blow-through steam in the event of such web breakage.

The control apparatus 10 also includes a blow-through steam sensing means 44 which is disposed between a separator tank 46 and the outlet valve 22 for sensing the momentum of blow-through steam exiting from the dryer 16. The blow-through steam sensing means 44 generates a fifth control signal proportional to the momentum of blow-through steam. The fifth signal is compared by the control means 38 for further determining the optimum relative setting of the outlet valve 22 in order to insure stable and efficient operation of the system for evacuating condensate from within the dryer 16.

Figure 7:
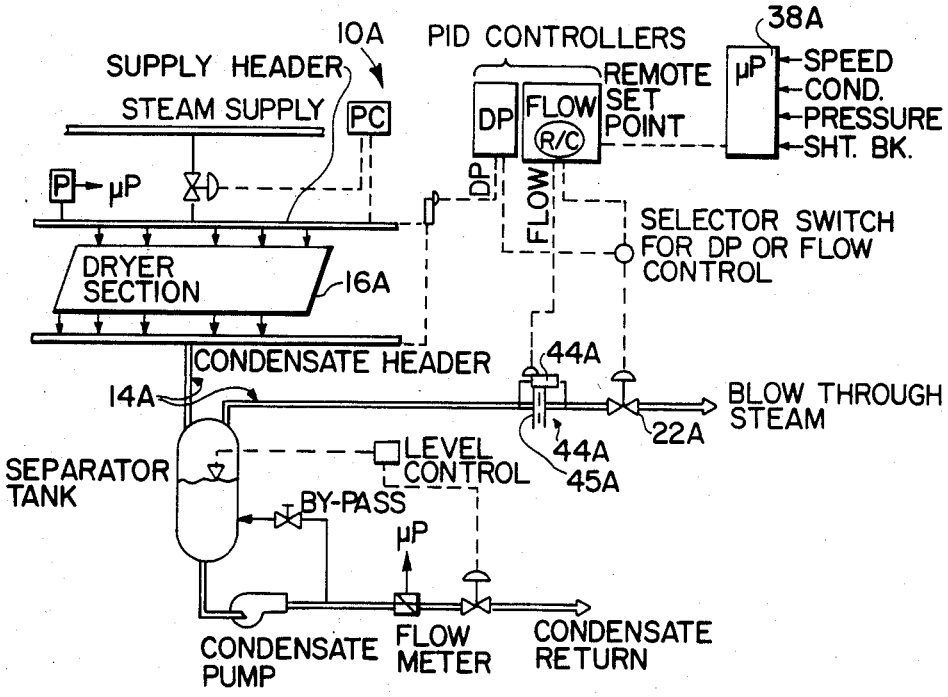
FIG. 7 is a diagramatic representation similar to that shown in FIG. 6 but combined with a conventional differential and/or flow control system for manual backup operation.

FIG. 7 shows an alternative embodiment in which the control apparatus 10A includes an orifice flowmeter means generally designated 43A disposed within the outlet line 14A for measuring the blow-through steam momentum. The orifice flowmeter 43A includes a flow restriction passage 45A for providing a pressure drop which is directly proportional to the blow-through momentum. The blow-through steam sensing means 44A is connected across the passageway 45A for sensing the steam blow-through momentum.

In a preferred embodiment of the present invention, the control means 38 is a microprocessor and the dryer 16 includes a radial siphon means 48 shown diagrammatically in FIG. 6 which is disposed within the dryer 16 for removing condensate therefrom. The siphon means 48 includes a siphon pipe having an inside diameter of less than 2.29 centimeters.

As shown in FIG. 6, the controller means 38, which may be a microprocessor, has a number of inputs including a machine speed input 50, a condensate flow input 52, an input line pressure input 54, a break input 56, and a blow-through input 58. The output of the control 38 has at least one set point to control the blow-through flow rate which is then sensed for feedback control. The controller means 38 has inputs for condensate flow rate 52 and machine speed 50. Additionally, the controller may have an input 54 for steam pressure. Furthermore, the blow-through control set point is a value proportional to the blow-through momentum. The set point value corresponds to 1 to 3 pounds per square inch above the minimum differential pressure and preferably 2 pounds per square inch. The system 10 utilizes steam bleed openings 60 in the dryer siphons and radial siphon pipes 48 which have an inside diameter of less than 2.29 centimeters.

In a preferred embodiment of the present invention, the flow sensing meters 44 are vortex meters and the system may be applied to condensible vapors other than steam. The control means output 62 may provide set points for both the circulation valve and the thermal compressor valve in a common thermal compressor system in FIG. 7. The control means may be set to maintain, as a minimum, a specified volume flow rate to insure adequate volumetric purging of non-condensible gases.

The set point values for blow-through momentum will decrease with increasing condensate flow rate and will increase with increased machine speed.

As shown in FIG. 7, the system may be combined with conventional differential and/or flow control system for manual backup operation.

In operation of the present system with the appropriate differential pressure for normal operation must be set somewhat higher than the minimum differential in order to accommodate occasional upsets in the operation. Experience has shown that approximately 2 pounds per square inch added differential pressure should be adequate. The operation of the present system is further enhanced by the use of small radial siphon pipes and steam bleed openings and low loss vortex flowmeters as described hereinbefore. Such low pressure losses can be achieved either by an increased radial pipe size or by lower blow-through. The present invention utilizes the fact that the increase in the minimum differential pressure is relatively small when reducing the size of the radial pipe while the reduction in blow-through sensitivity is quite significant. By controlling the momentum to a value which gives about 2 pounds per square inch higher differential than the minimum, and by using the small radial pipes, the blow-through does not change as much during upsets in machine operation. As a result, the valves and condensors and connecting pipes are less likely to be undersized so that the system continues to operate in a stable condition even though the differential pressure is low. The use of the steam bleed opening insures that the dryer can recover from even major system upsets. The set point of blow-through momentum will also cause the differential to increase in order to achieve set point flow plus the system will automatically increase the set point due to the reduced condensate flow. Additionally, the required differential to evacuate the flooded dryers is simultaneously reduced by the increase in sensitivity of the evacuated condensate by the additional blow-through steam which enters the steam bleed openings located above the condensate layer. The combined effect of these three actions is to provide a heretofore unachievable range of stability of operation.

By providing a simple orifice flowmeter with small restriction of a vortex type meter, the pressure drop can be measured and used as input for the controller.

The desired operating set points can be determined by first locating the minimum differential pressure point for the given conditions of speed, dryer pressure, condensing rate and siphon size. To this value is added some increment, usually 2 pounds per square inch, to allow for minor upsets in operation. Blow-through which corresponds to this differential is then used to calculate the momentum of the blow-through which is used as the set point.

The present invention utilizes the aforementioned parameters as inputs to the controller which, in turn, calculates the appropriate set point and this system does not require the continual adjustment of the set point or monitoring of the resultant response as described in the prior art proposals.

What is claimed is:

1. A control apparatus for controlling the differential pressure between a steam inlet line and an outlet line of a web dryer, said apparatus comprising in combination:

a selectively controllable outlet valve disposed within the outlet line of the dryer for selectively controlling the flow of steam, condensate and non-condensible gases out of the dryer;

outlet valve actuating means disposed adjacent to said outlet valve for selectively controlling the operation of said outlet valve between a fully open and a fully closed setting therof;

speed sensing means disposed adajcent to the dryer for sensing the rotational speed of the dryer and for generating a first control signal proportional to said sensed rotational speed of the dryer;

rate of condensation sensing means for sensing the rate at which a layer of condenste build up within the dryer and for generating a second control signal proportional to said sensed rate of buildup; and control means operably connected to said outlet actuating means for selectively energizing said actuating means in response to said control signals generated respectively by said speed sensing means and said rate of condensation sensing means such that the control means compares said signals from said speed sensing means and said rate of condensation sensing means to determine the minimum setting of the outlet valve and increasing said minimum setting by an optimum amount so that flooding of the dryer with condensate is inhibited while the differential pressure between the inlet and outlet lines is maintained as low as possible thereby avoiding the possibility of flooding caused by increased condensate flow, fluctuation in pressure differential and speed increase of the dryer.

2. A control apparatus as set forth in claim 1, further including:

steam inlet pressure sensing means for sensing the pressure of steam between said inlet valve and the dryer and for generating a third control signal which is proportional to said sensed pressure between said inlet valve and the dryer, said third control signal from said steam inlet pressure sensing means being compared by said control means for further determining said optimum relative setting of said outlet valve.

3. A control apparatus as set forth in claim 1, further including:

sheet break sensing means disposed adjacent to the web for sensing a break therein and for generating a fourth control signal indicative of such web breakage, said fourth control signal from said break sensor being compared by said control means for further determining the optimum relative setting of the outlet valve in order to inhibit the excessive wastage of blow-through steam in the event of such web breakage.

4. A control apparatus as set forth in claim 1, further including:

a blow-through steam sensing means disposed between the dryer and said outlet valve for sensing the momentum of blow-through steam exiting from the dryer, said blow-through steam sensing means generating a fifth control signal proportional to the momentum of the blow-through steam, said fifth signal being compared by said control means for further determining the optimum relative setting of the outlet valve in order to insure stable and efficient operation of the system for evacuating condensate from within the dryer.

5. A control apparatus as set forth in claim 4, further including:

an orifice flowmeter means disposed within the outlet line for measuring said blow-through steam momentum, said orifice flowmeter having a flow restricting passage for providing a pressure drop which is directly proportional to the blow-through momentum;

said blow-through steam sensing means being connected across said passageway for sensing said steam blow-through momentum.

6. A control apparatus as set forth in claim 1, wherein said control means is a microprocessor.

7. A control apparatus as set forth in claim 1 wherein the dryer further includes:

radial siphon means disposed within the dryer for removing condensate therefrom.

8. A control apparatus as set forth in claim 7 wherein said radial siphon means includes at least one siphon pipe having an inside diameter of less than 2.29 centimeters.

* * * * *